US010345740B1

(12) United States Patent
Minamoto

(10) Patent No.: US 10,345,740 B1
(45) Date of Patent: Jul. 9, 2019

(54) TONER CASE AND IMAGE FORMING APPARATUS

(71) Applicant: KYOCERA Document Solutions Inc., Osaka (JP)

(72) Inventor: Riku Minamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/995,504

(22) Filed: Jun. 1, 2018

(30) Foreign Application Priority Data

Dec. 26, 2017 (JP) ..... 2017-248955

(51) Int. Cl.
*G03G 15/08* (2006.01)
*G03G 21/16* (2006.01)

(52) U.S. Cl.
CPC ..... *G03G 15/0889* (2013.01); *G03G 15/0865* (2013.01); *G03G 21/1676* (2013.01)

(58) Field of Classification Search
CPC ..... G03G 15/0867; G03G 15/0889; G03G 15/0891; G03G 21/1676; G03G 15/0865
See application file for complete search history.

(56) References Cited

U.S. PATENT DOCUMENTS

2010/0272474 A1* 10/2010 Sato ..... G03G 15/0889 399/254
2013/0322929 A1 12/2013 Kobayashi

FOREIGN PATENT DOCUMENTS

JP 2009-222807 A 10/2009
JP 2012-190046 A 10/2012
JP 2016-048279 A 4/2016

OTHER PUBLICATIONS

Extended European Search Report issued by the European Patent Office dated Nov. 28, 2018, which corresponds to EP18175442.5-1022 and is related to U.S. Appl. No. 15/995,504.

* cited by examiner

*Primary Examiner* — Hoang X Ngo
(74) *Attorney, Agent, or Firm* — Studebaker & Brackett PC

(57) ABSTRACT

A toner case includes a case main body and an agitator. The case main body stores a toner. The agitator rotates around a rotation axis extending along one direction and agitates the toner stored in the case main body. The case main body includes a curve and a recess. The curve is curved in an arc shape around the rotation axis. The recess is recessed from the curve toward a side remote from the rotation axis. In a state where the agitator is in a first rotating position, a part of the agitator comes into contact with an inner circumferential face of the curve so that the part of the agitator is in a bent state. In a state where the agitator is in a second rotating position, the part of the agitator is inserted into the recess.

14 Claims, 15 Drawing Sheets

TONER CASE AND IMAGE FORMING APPARATUS

INCORPORATION BY REFERENCE

This application is based on and claims the benefit of priority from Japanese patent application No. 2017-248955 filed on Dec. 26, 2017, which is incorporated by reference in its entirety.

BACKGROUND

The present disclosure relates to a toner case and an image forming apparatus including the toner case.

An image forming apparatus, such as a printer, a copying machine and a multifunctional peripheral, forms a toner image by supplying a toner (a developer) from a developing device to an image carrier, such as a photosensitive drum. The toner supplied to form such a toner image is replenished from a toner case to the developing device. The toner case includes a case main body storing the toner and an agitator rotating around a rotation axis and agitating the toner stored in the case main body, for example.

SUMMARY

In accordance with an aspect of the present disclosure, a toner case includes a case main body and an agitator. The case main body stores a toner. The agitator rotates around a rotation axis extending along one direction and agitates the toner stored in the case main body. The case main body includes a curve and a recess. The curve is curved in an arc shape around the rotation axis. The recess is recessed from the curve toward a side remote from the rotation axis. In a state where the agitator is in a first rotating position, a part of the agitator comes into contact with an inner circumferential face of the curve so that the part of the agitator is in a bent state. In a state where the agitator is in a second rotating position, the part of the agitator is inserted into the recess.

In accordance with an aspect of the present disclosure, an image forming apparatus includes the toner case and an attachment part to which the toner case is attached.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

First, an entire structure of the image forming apparatus 1 will be described.

Figure 1:
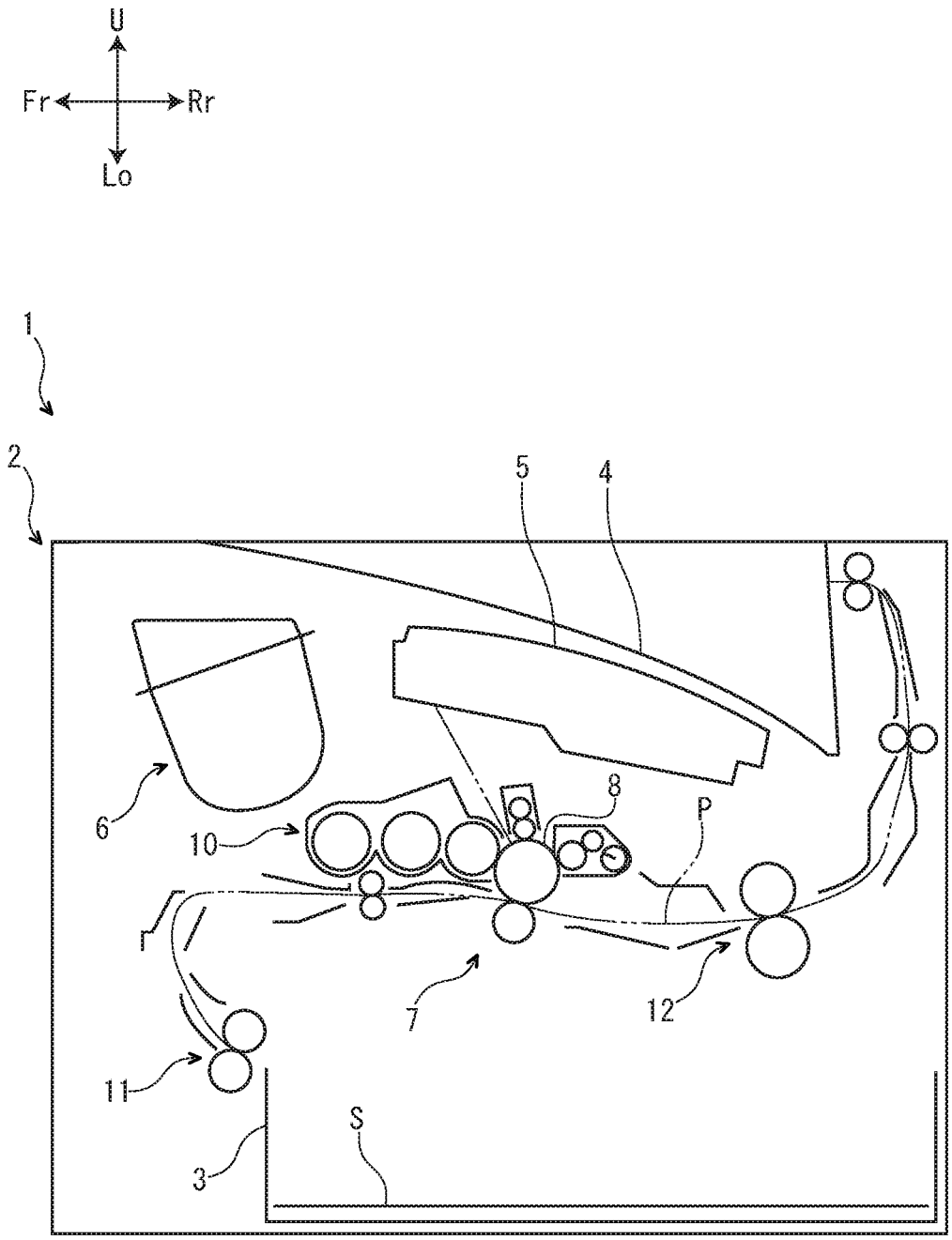
FIG. 1 is a schematic view showing an image forming apparatus according to an embodiment of the present disclosure.

In the following description, for convenience of explanation, a left side of a paper plan of FIG. 1 is defined to be a front side of the image forming apparatus 1. Arrows Fr, Rr, L, R, U and Lo shown in each figure respectively indicate a front side, a rear side, a left side, a right side, an upper side and a lower side of the image forming apparatus 1.

With reference to FIG. 1, the image forming apparatus 1 is a printer, for example. The image forming apparatus 1 includes a box-shaped apparatus main body 2. In a lower portion of the apparatus main body 2, a sheet feeding cassette 3 storing a sheet S (an example of a recording medium) is stored. On an upper face of the apparatus main body 2, an ejected sheet tray 4 is provided. In an upper portion of the apparatus main body 2, an exposing device 5 is stored below the ejected sheet tray 4. In the upper portion of the apparatus main body 2, a toner container 6 (an example of a toner case) is stored at a front side of the exposing device 5.

In the apparatus main body 2, a conveying path P for the sheet S is provided. At an upstream end portion of the conveying path P, a sheet feeding part 11 is provided. At a middle portion of the conveying path P, an image forming part 7 is provided. The image forming part 7 includes a photosensitive drum 8 and a developing device 10 (an example of an attachment part). Ata downstream portion of the conveying path P, a fixing device 12 is provided.

Next, an operation of the image forming apparatus 1 having the above configuration will be described.

First, laser light (refer to a two-dotted chain line in FIG. 1) emitted from the exposing device 5 exposes the photosensitive drum 8 to form an electrostatic latent image on the photosensitive drum 8. Next, the electrostatic latent image on the photosensitive drum 8 is developed by the developing device 10 to form a toner image. Thereby, an image forming operation is finished.

On the other hand, the sheet S fed from the sheet feeding cassette 3 by the sheet feeding part 11 is conveyed to the image forming part 7 at a suitable timing for the above image forming operation, and the above toner image is transferred from the photosensitive drum 8 to the sheet S at the image forming part 7. The sheet S on which the toner image is transferred is conveyed to a downstream side along the conveying path P and enters the fixing device 12. The fixing device 12 fixes the toner image on the sheet S. The sheet S on which the toner image is fixed is ejected on the ejected sheet tray 4 from a downstream end portion of the conveying path P.

Next, the toner container 6 will be described in detail.

Figure 2:
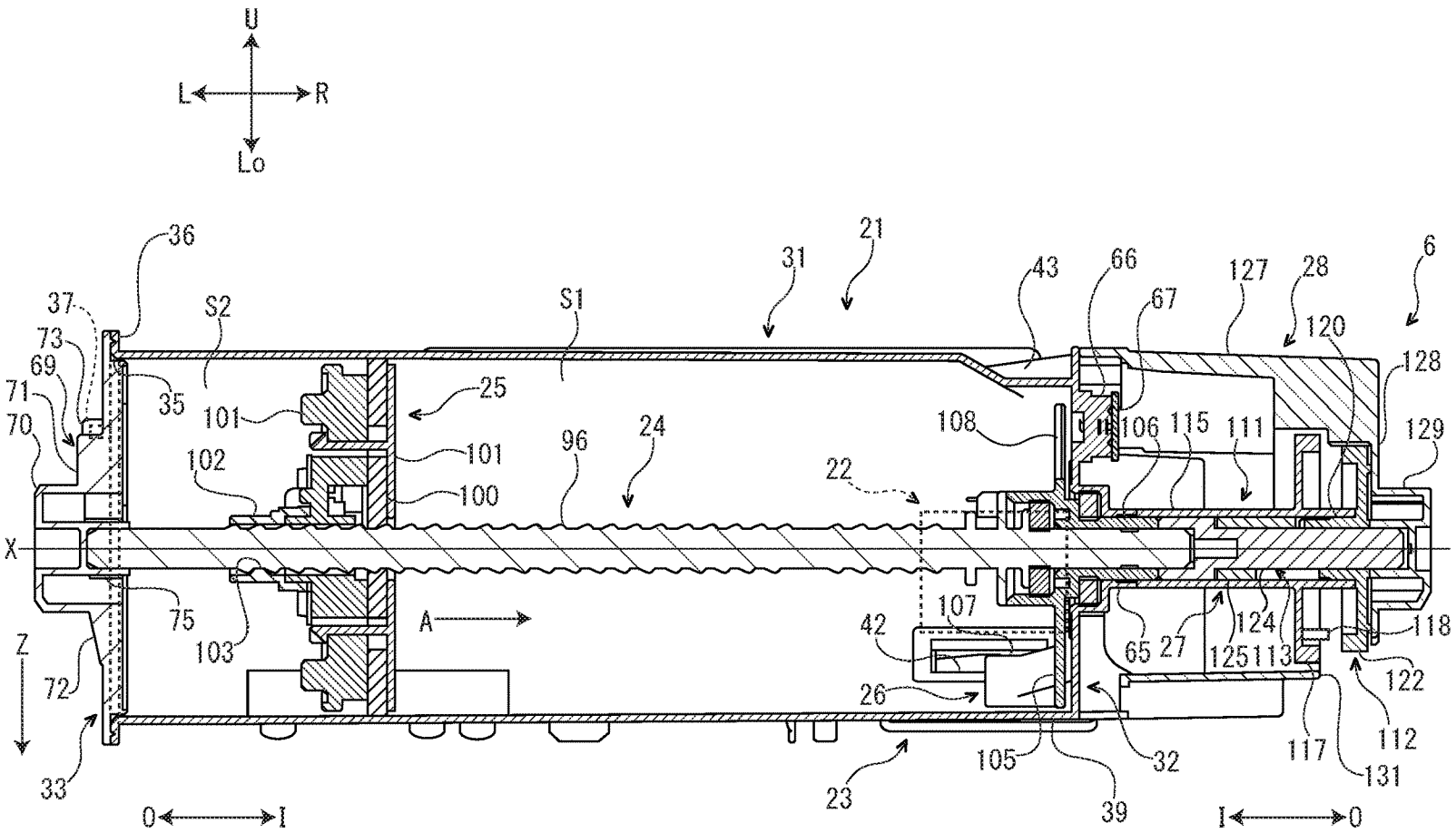
FIG. 2 is a sectional view showing a toner container according to the embodiment of the present disclosure.

With reference to FIG. 2, the toner container 6 is formed in a shape elongated in the left-and-right direction (an example of one direction). An arrow I suitably shown in each figure after FIG. 2 indicates an inside in the left-and-right direction of the toner container 6 (a side close to a center portion of the toner container 6 in the left-and-right direction). An arrow O suitably shown in each figure after FIG. 2 indicates an outside in the left-and-right direction of the toner container 6 (a side remote from the center portion of the toner container 6 in the left-and-right direction). In the toner container 6, a rotation axis X extending along the left-and-right direction is set.

Figure 3:
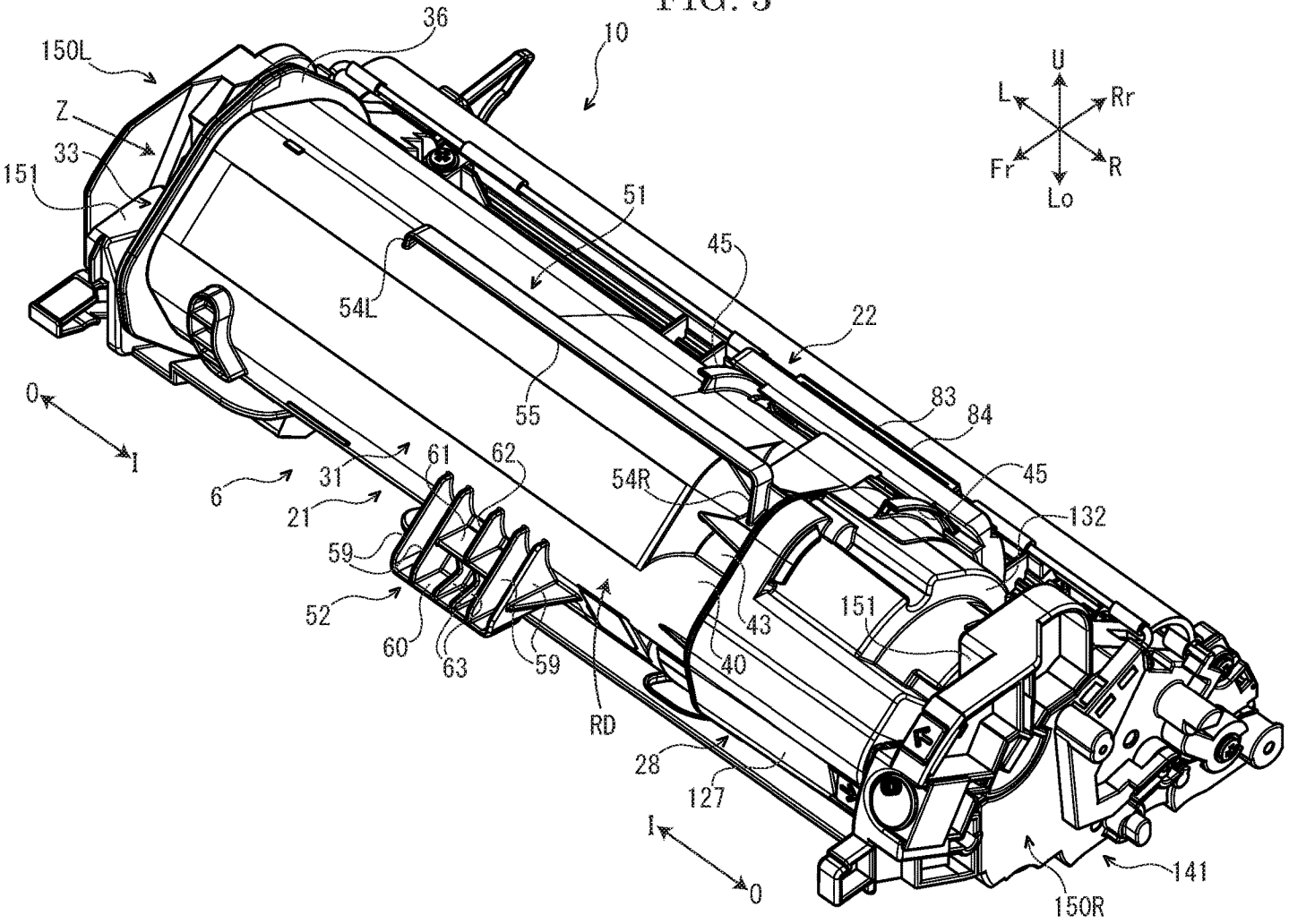
FIG. 3 is a perspective view showing a state where the toner container is in a first attachment position, in the embodiment of the present disclosure.

With reference to FIG. 3, the toner container 6 is attached to the developing device 10 along an attachment direction Z crossing the left-and-right direction vertically.

Figure 4:
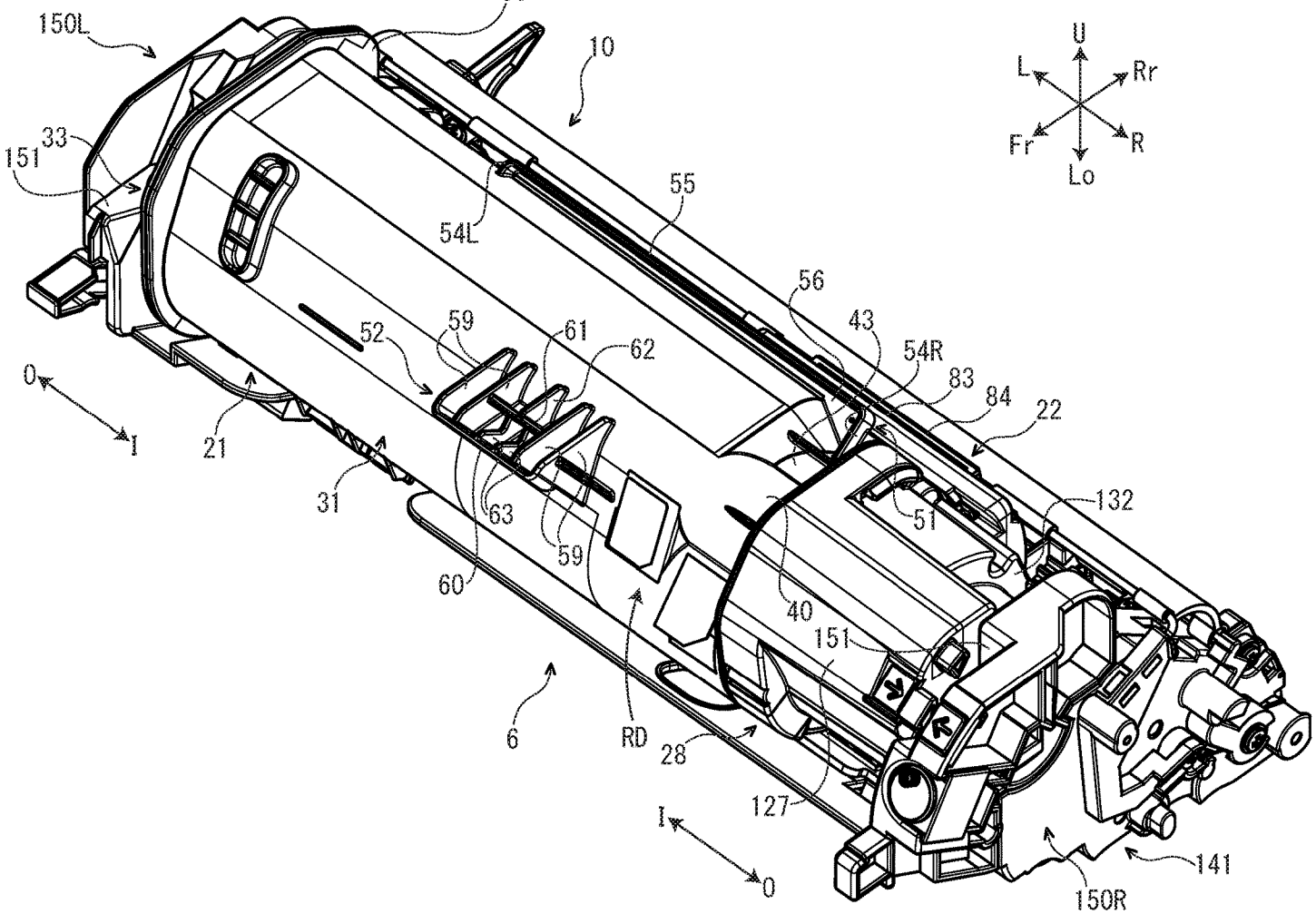
FIG. 4 is a perspective view showing a state where the toner container is in a second attachment position, in the embodiment of the present disclosure.

With reference to FIG. 3 and FIG. 4, the toner container 6 rotates between a first attachment position (refer to FIG. 3) and a second attachment position (refer to FIG. 4), in a state where the toner container 6 is attached to the developing device 10. An arrow RD suitably shown in each figure after FIG. 3 indicates a rotating direction of the toner container 6 when the toner container 6 rotates from the first attachment position to the second attachment position (hereinafter, called as "a rotating direction RD"). Hereinafter, a direction, such as an upper side and a lower side, is described on the basis of a state where the toner container 6 is in the second attachment position.

With reference to FIG. 2, the toner container 6 includes a case main body 21, a discharge shutter 22 arranged at a right rear side of the case main body 21, a seal member 23 arranged at a right lower side of the case main body 21, a shaft 24 (an example of a rotator) stored in the case main body 21, a mover 25 mounted to an outer circumference of the shaft 24, an agitator 26 arranged at a right end side of the case main body 21, a connecting mechanism 27 arranged at a right side (the outside in the left-and-right direction) of the case main body 21 and a cover 28 covering the connecting mechanism 27. Hereinafter, the above members constituting the toner container 6 will be described in the above order.

First, the case main body 21 of the toner container 6 will be described.

With reference to FIG. 2, the case main body 21 is formed in a box-like shape elongated in the left-and-right direction. In the case main body 21, a first space S1 and a second space S2 are formed. The first space S1 stores the toner (the developer). The second space S2 is provided at a left side of the first space S1. The second space S2 does not store the toner.

The case main body 21 includes a cylindrical circumferential wall 31 extending along the left-and-right direction, a side wall 32 closing a right end portion (one end portion in the left-and-right direction) of the circumferential wall 31 and a lid 33 closing a left end portion (the other end portion in the left-and-right direction) of the circumferential wall 31.

At the left end portion of the circumferential wall 31 of the case main body 21, an opening 35 is provided. On an outer circumferential face of the left end portion of the circumferential wall 31, an annular flange 36 is protruded around the opening 35. On each of a front upper portion and a rear upper portion of an outer face (a left face) of the flange 36, an engagement projection 37 is protruded.

Figure 5:
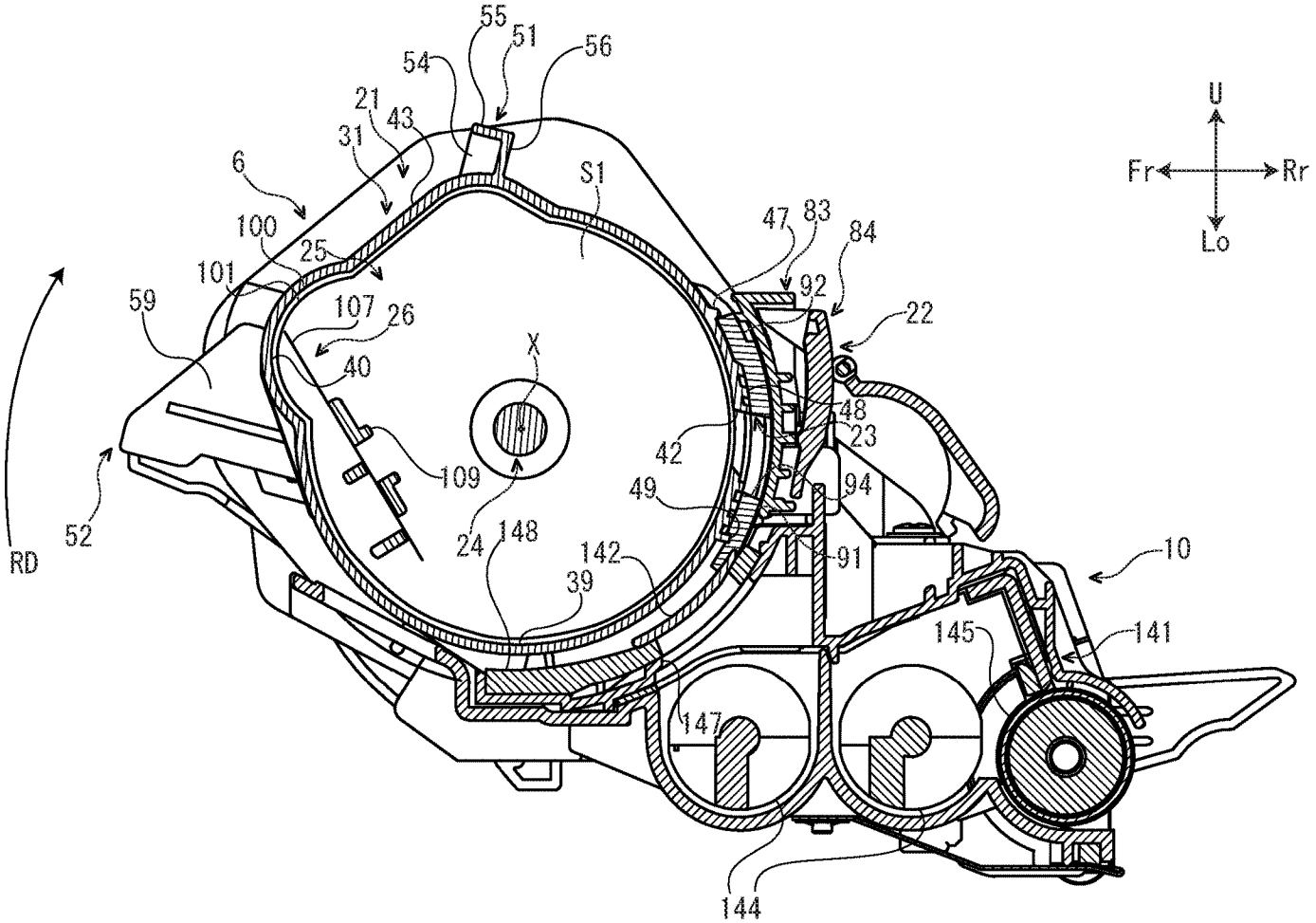
FIG. 5 is a sectional view showing the state where the toner container is in the first attachment position, in the embodiment of the present disclosure.
Figure 6:
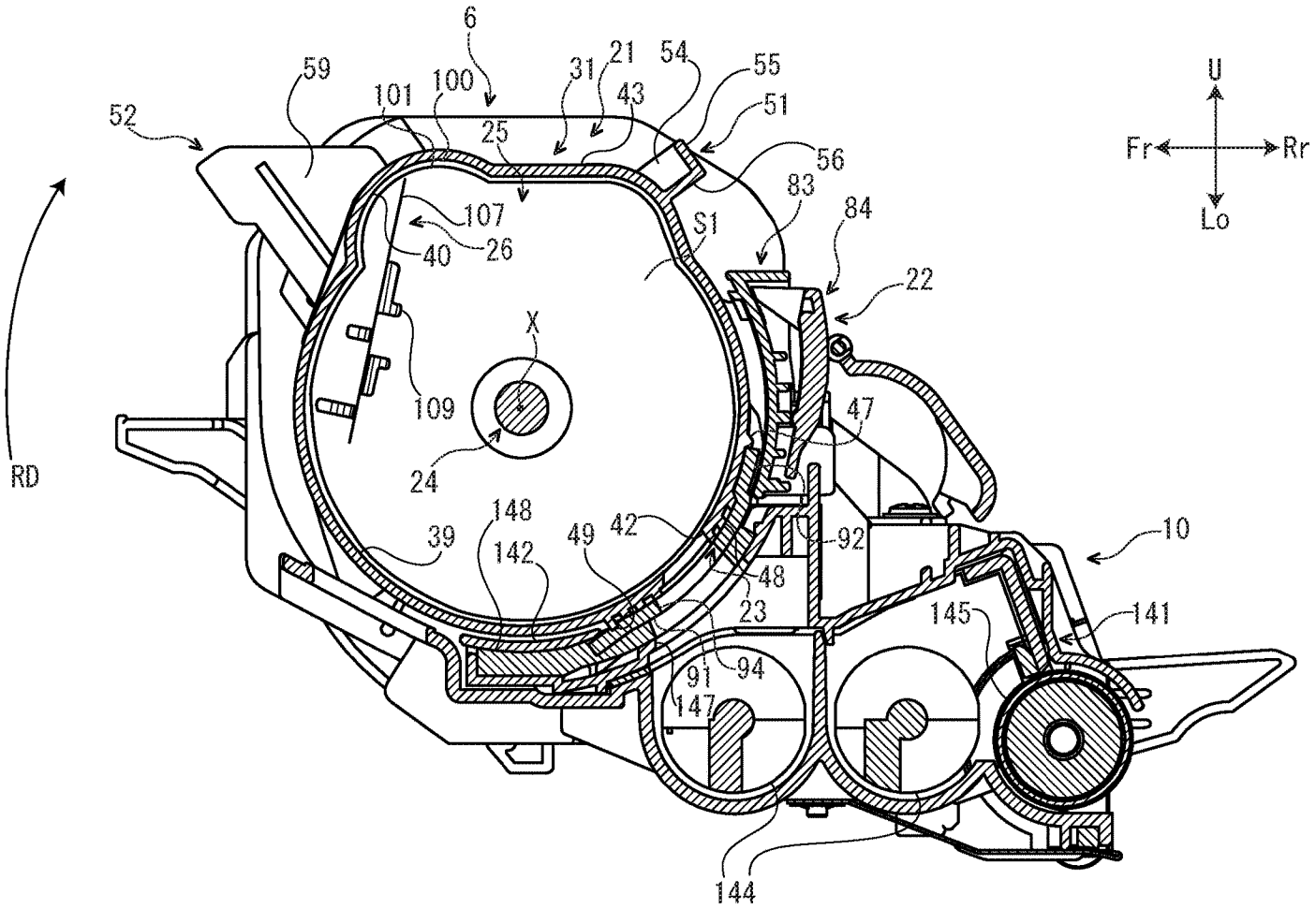
FIG. 6 is a sectional view showing the state where the toner container is in the second attachment position, in the embodiment of the present disclosure.

With reference to FIG. 5 and FIG. 6, at the right end portion of the circumferential wall 31 of the case main body 21, a curve 39 and a recess 40 are provided. The curve 39 is curved in an arc shape around the rotation axis X. At a rear lower end portion of the curve 39, a discharge port 42 through which the toner is discharged from the first space S1 of the case main body 21 is provided. The recess 40 is provided continuously with the curve 39, and is recessed from the curve 39 toward a front upper side (a side remote from the rotation axis X). The recess 40 is curved in an arc shape. A radius of curvature of the recess 40 is smaller than a radius of curvature of the curve 39. With reference to FIG. 3 and FIG. 4, on an outer circumferential face of the right end portion of the circumferential wall 31, a depression 43 is provided at a rear side of the recess 40 (a downstream side in the rotating direction RD).

Figure 7:
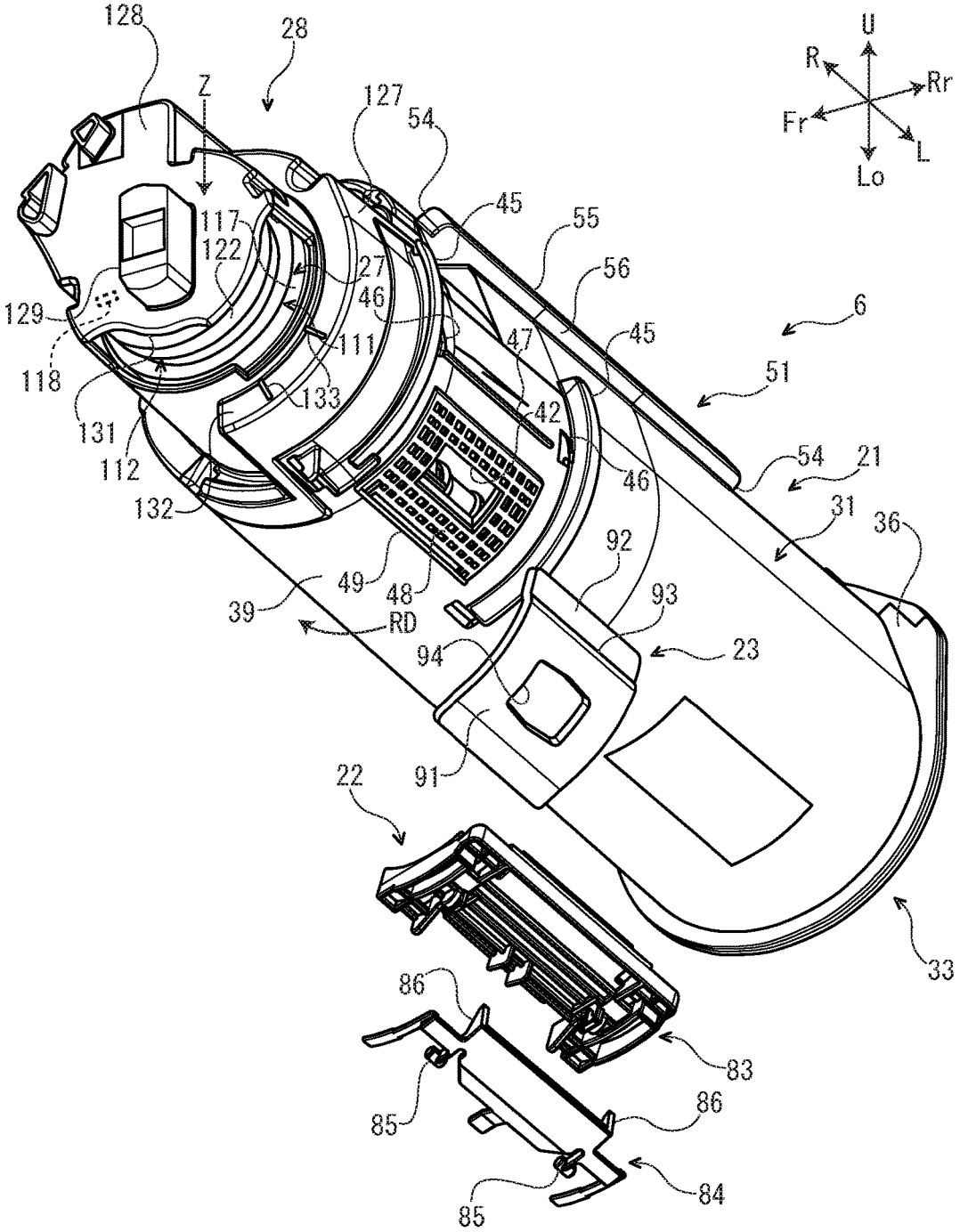
FIG. 7 is a disassembled perspective view showing the toner container according to the embodiment of the present disclosure.
Figure 8:
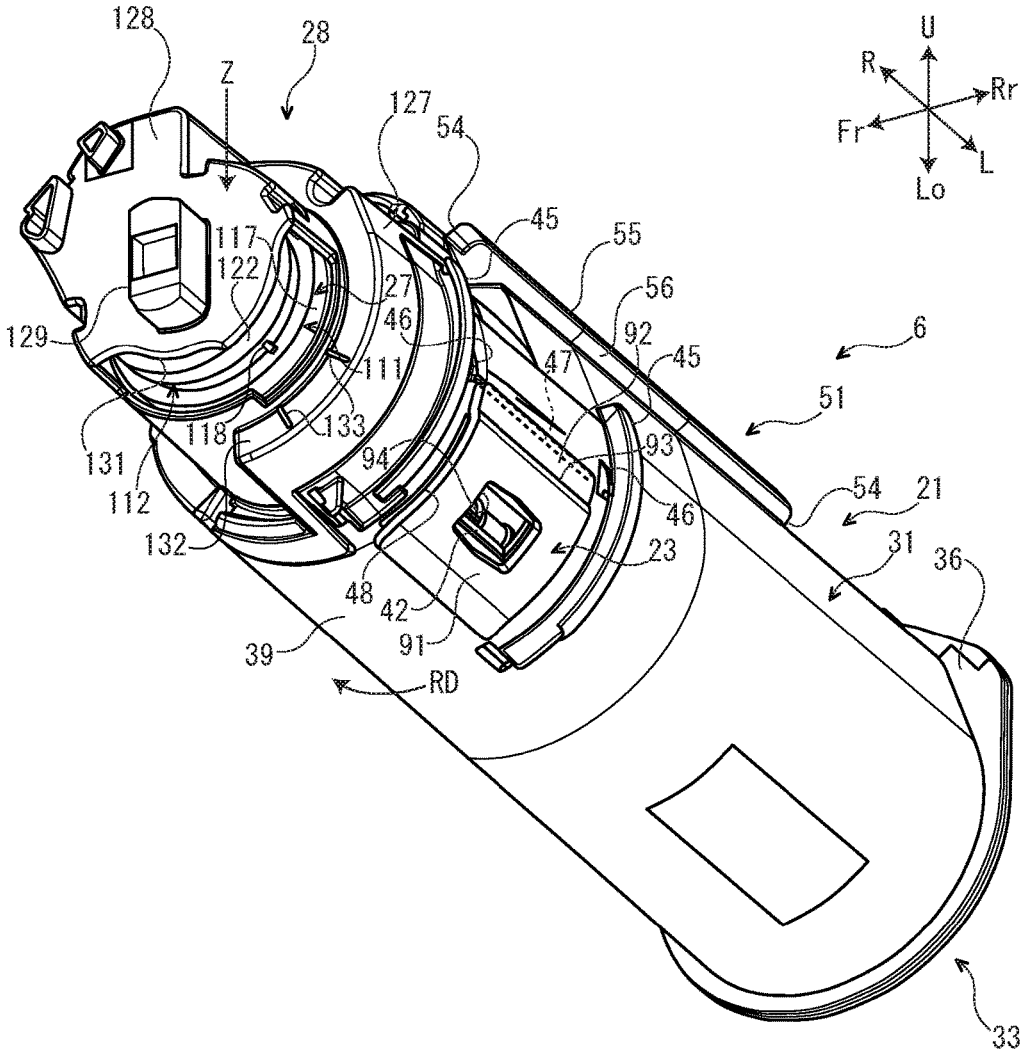
FIG. 8 is a perspective view showing a state where a discharge shutter is detached from a case main body, in the toner container according to the embodiment of the present disclosure.

With reference to FIG. 7 and FIG. 8, on the outer circumferential face of the circumferential wall 31 of the case main body 21, a pair of support ribs 45 are protruded with an interval in the left-and-right direction. The pair of support ribs 45 are arranged at both sides of the discharge port 42 in the left-and-right direction. Each support rib 45 is curved in an arc shape along the outer circumferential face of the circumferential wall 31. On the outer circumferential face of the circumferential wall 31, a pair of engagement ribs 46 are protruded with an interval in the left-and-right direction. The pair of engagement ribs 46 are arranged between the pair of support ribs 45.

On the outer circumferential face of the circumferential wall 31 of the case main body 21, an indicating rib 47 indicating an affix position of the seal member 23 is protruded. The indicating rib 47 is arranged between the pair of support ribs 45 and between the pair of engagement ribs 46. The indicating rib 47 extends linearly along the left-and-right direction. The indicating rib 47 is arranged at a rear upper side (the upstream side in the rotating direction RD) of the discharge port 42, and its position overlaps with a position of the discharge port 42 in the left-and-right direction.

On the outer circumferential face of the circumferential wall 31 of the case main body 21, a pedestal 48 is protruded around the discharge port 42. The pedestal 48 has a rectangular outline. On an outer face of the pedestal 48, a plurality of grooves are formed. At a front end portion of the outer face of the pedestal 48, an assist rib 49 is protruded at an opposite side of the indicating rib 47 with respect to the discharge port 42. The assist rib 49 extends linearly along the left-and-right direction. The assist rib 49 is arranged at a front lower side (the downstream side in the rotating direction RD) of the discharge port 42, and its position overlaps with a position of the discharge port 42 in the left-and-right direction.

With reference to FIG. 3 and FIG. 4, on the outer circumferential face of the circumferential wall 31 of the case main body 21, a first protrusion 51 and a second protrusion 52 are protruded such that their positions overlap with each other in the left-and-right direction. The first protrusion 51 and the second protrusion 52 are provided at a center portion of the whole of the toner container 6 in the left-and-right direction. The first protrusion 51 and the second protrusion 52 are provided at an interval in the front-and-rear direction (a direction vertically crossing the left-and-right direction). The first protrusion 51 has a length in the left-and-right direction longer than that of the second protrusion 52 and has a protruding length from the outer circumferential face of the circumferential wall 31 lower than that of the second protrusion 52.

The first protrusion 51 of the circumferential wall 31 of the case main body 21 includes a pair of base pieces 54L and 54R, a coupling piece 55 and a covering piece 56. The pair of base pieces 54L and 54R are protruded from the outer circumferential face of the circumferential wall 31 at an interval in the left-and-right direction. The coupling piece 55 extends along the left-and-right direction and couples protruding end portions of the pair of base pieces 54L and 54R. The covering piece 56 covers a space surrounded by the outer circumferential face of the circumferential wall 31, the pair of base pieces 54L and 54R and the coupling piece 55 from the rear side (a side remote from the second protrusion 52). The right base piece 54R has a protruding length from the outer circumferential face of the circumferential wall 31 longer than that of the left base piece 54L.

The second protrusion 52 of the circumferential wall 31 of the case main body 21 includes four flat plates 59, a coupling plate 60, a first reinforcing plate 61, a second reinforcing plate 62 and a pair of third reinforcing plates 63. The four flat plates 59 are protruded from the outer circumferential face of the circumferential wall 31 at intervals in the left-and-right direction. The coupling plate 60 extends along the left-and-right direction, and couples front end portions (end portions at a side remote from the first protrusion 51) of the four flat plates 59. The first reinforcing plate 61 couples center portions in the front-and-rear direction of the two flat plates 59 arranged inside in the left-and-right direction among the four flat plates 59. The second reinforcing plate 62 couples a center portion in the left-and-right direction of the first reinforcing plate 61 and the outer circumferential face of the circumferential wall 31. The pair of third reinforcing plates 63 are arranged at an interval in the left-and-right direction, and couple the coupling plate 60 and the first reinforcing plate 61. An upper end portion of each third reinforcing plate 63 is recessed downward in a V-shape.

Figure 9:
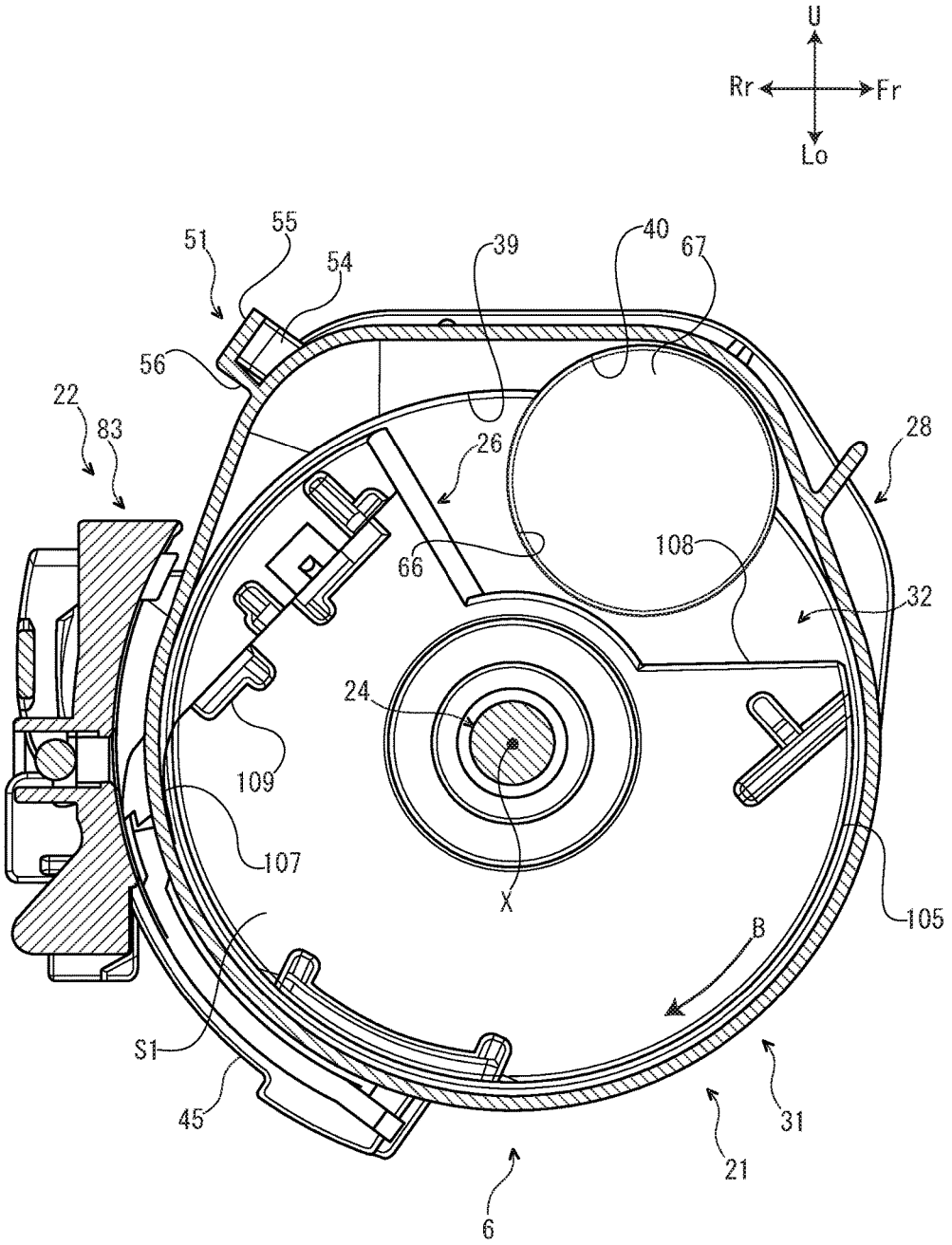
FIG. 9 is a sectional view showing a state where an agitator is in a first rotating position, in the toner container according to the embodiment of the present disclosure.
Figure 10:
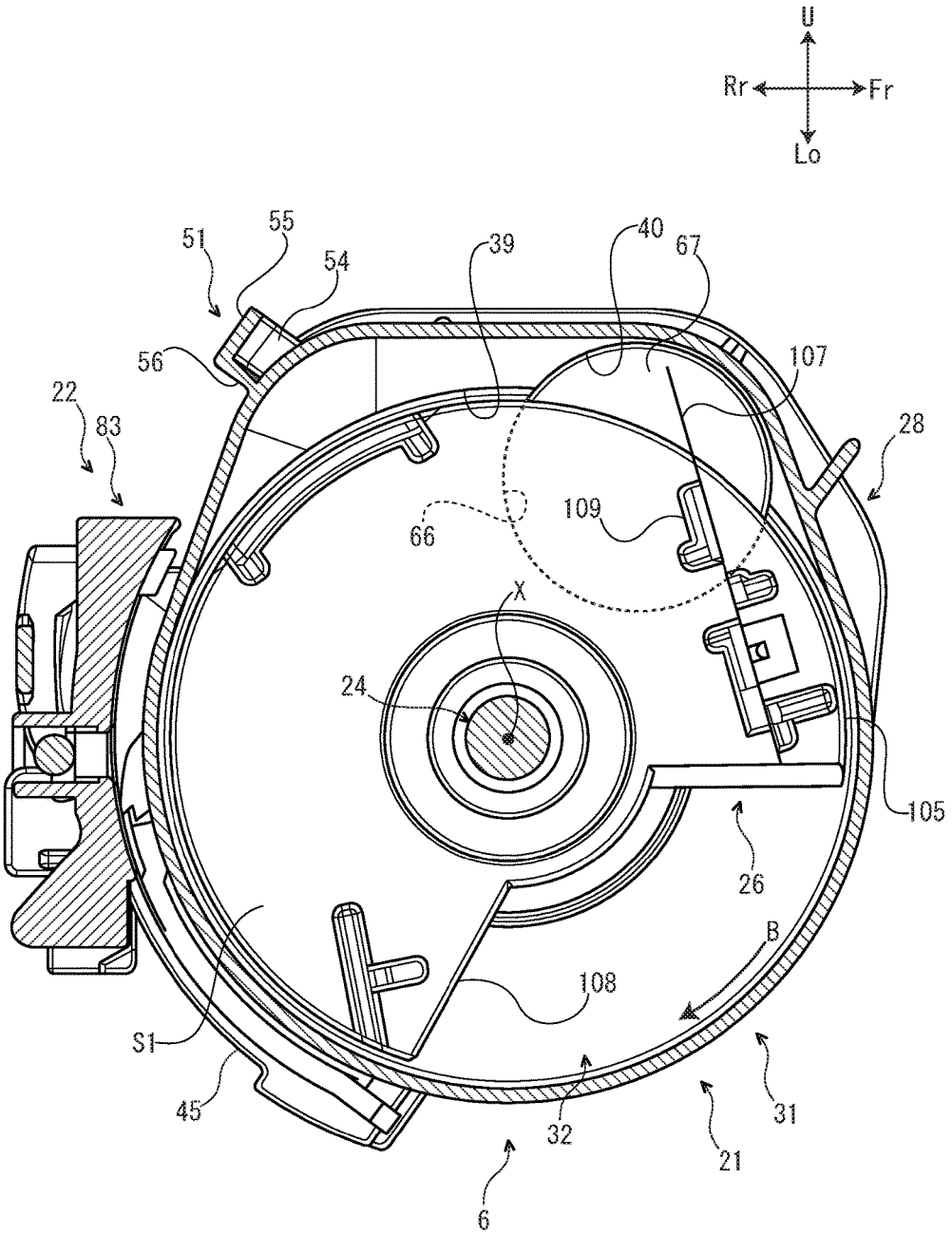
FIG. 10 is a sectional view showing a state where the agitator is in a second rotating position, in the toner container according to the embodiment of the present disclosure.

With reference to FIG. 2, FIG. 9 and FIG. 10, the side wall 32 of the case main body 21 is formed integrally with the circumferential wall 31 of the case main body 21. The side wall 32 is provided along a plane crossing the rotation axis X vertically. On a center portion of an outer face (a right face) of the side wall 32, a bearing 65 is protruded. The bearing 65 is formed in a cylindrical shape with the rotation axis X as a center, and extends along the left-and-right direction. On a front upper corner portion (a corner portion at the side remote from the rotation axis X) of the outer face of the side wall 32, a replenishment port 66 through which the toner is replenished to the case main body 21 is protruded. The replenishment port 66 is formed in a cylindrical shape, and extends along the left-and-right direction. A right end portion of the replenishment port 66 is closed with a cap 67. An upper portion of the replenishment port 66 overlaps with the recess 40 of the circumferential wall 31 in the left-and-right direction.

Figure 11:
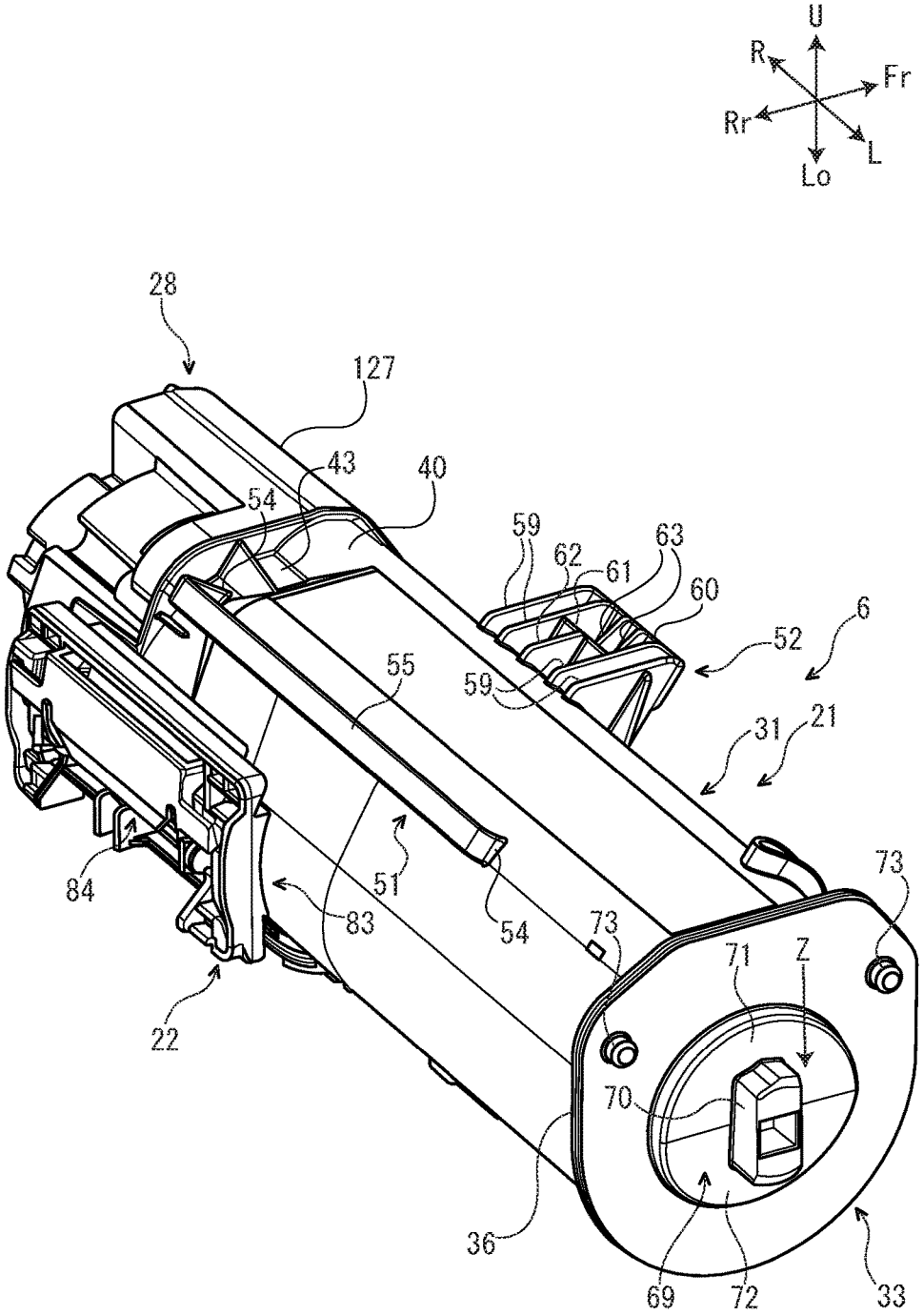
FIG. 11 is a perspective view showing the toner container according to the embodiment of the present disclosure.
Figure 12:
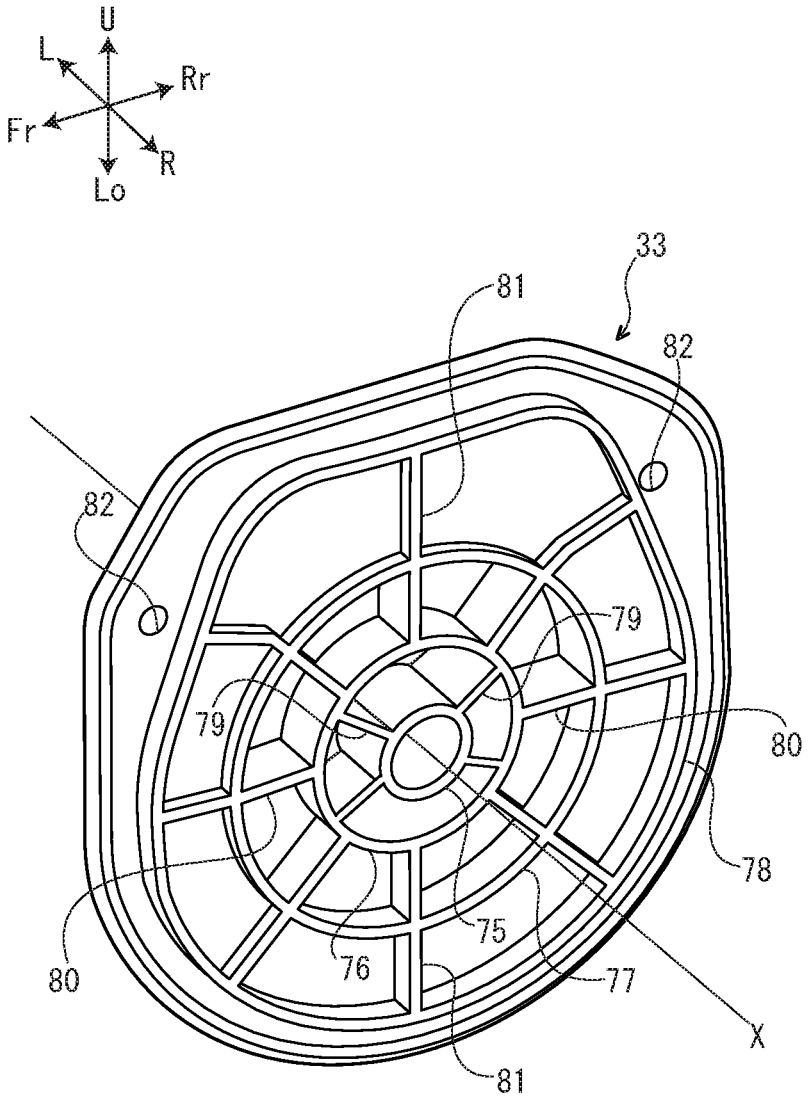
FIG. 12 is a perspective view showing a lid according to the embodiment of the present disclosure.

With reference to FIG. 2, FIG. 11 and FIG. 12, the lid 33 of the case main body 21 is formed separately from the circumferential wall 31 and the side wall 32 of the case main body 21. The lid 33 is provided along a plane vertically crossing the rotation axis X.

On a center portion of an outer face (a left face) of the lid 33 of the case main body 21, a step 69 is protruded. The step 69 is formed in a perfect circular shape when viewed in the left-and-right direction. On a center portion of an outer face (a left face) of the step 69, a protruding piece 70 is protruded. The protruding piece 70 extends along the attachment direction Z. A center portion in the upper-and-lower direction of the protruding piece 70 is recessed to the right side (the inside in the left-and-right direction). On the outer face of the step 69, a parallel part 71 and an inclined part 72 are provided around the protruding piece 70. The parallel part 71 is provided at an upper half portion (an upstream half portion in the attachment direction Z) of the outer face of the step 69. The parallel part 71 is provided in parallel to the outer face of the lid 33. The inclined part 72 is provided at a lower half portion (a downstream half portion in the attachment direction Z) of the outer face of the step 69. The inclined part 72 is inclined such that its protruding height from the outer face of the lid 33 is lowered from the upper side (the upstream side in the attachment direction Z) to the lower side (the downstream side in the attachment direction Z).

On a front upper portion and a rear upper portion of the outer face of the lid 33 of the case main body 21, bosses 73 are protruded at intervals from the step 69. A protruding height of each boss 73 from the outer face of the lid 33 is equal to or less than a protruding height of the step 69 from the outer face of the lid 33.

On a center portion of an inner face (a right face) of the lid 33 of the case main body 21, a supporting part 75 is protruded on a back side of the step 69. The supporting part 75 is formed in a cylindrical shape with the rotation axis X as a center, and extends along the left-and-right direction. A left end portion (an end portion at the outside in the left-and-right direction) of the supporting part 75 is closed by the center portion (the portion recessed to the right side) in the upper-and-lower direction of the protruding piece 70.

On the inner face of the lid 33 of the case main body 21, a first annular part 76, a second annular part 77, a third annular part 78, four inner circumferential side coupling parts 79, eight first outer circumferential side coupling parts 80 and eight second outer circumferential side coupling parts 81 are protruded. The first annular part 76 covers an outer circumference of the supporting part 75. The second annular part 77 covers an outer circumference of the first annular part 76. The third annular part 78 covers an outer circumference of the second annular part 77. The four inner circumferential side coupling parts 79 couple the supporting part 75 and the first annular part 76 (the innermost annular part). The eight first outer circumferential side coupling parts 80 couple the first annular part 76 and the second annular part 77. The eight second outer circumferential side coupling parts 81 couple the second annular part 77 and the third annular part 78. The first annular part 76 and the second annular part 77 are each formed in a perfect circular shape when viewed in the left-and-right direction. The third annular part 78 is formed in a non-perfect circular shape viewed in the left- and right direction. The inner circumferential side coupling parts 79 and the outer circumferential side coupling parts 80 and 81 are radially provided around the supporting part 75.

On the inner face of the lid 33 of the case main body 21, an engagement hole 82 is provided at a back side of each boss 73. Each engagement hole 82 is provided at an outer circumferential side (the side remote from the rotation axis X) of the third annular part 78. With each engagement hole 82, each engagement projection 37 of the circumferential wall 31 is engaged. Thereby, the lid 33 is positioned to the circumferential wall 31. The inner face of the lid 33 is welded to the outer face of the flange 36 of the circumferential wall 31 at the outer circumferential side of the third annular part 78. Thereby, the lid 33 is fixed to the circumferential wall 31.

Next, the discharge shutter 22 of the toner container 6 will be described.

With reference to FIG. 5 and FIG. 6, the discharge shutter 22 is provided along the outer circumferential face of the circumferential wall 31 of the case main body 21. The discharge shutter 22 is rotated along the outer circumferential face of the circumferential wall 31, and opens or closes the discharge port 42 of the circumferential wall 31 from the outer circumferential side.

With reference to FIG. 7, the discharge shutter 22 includes a shutter main body 83 and a stopper 84 mounted on an outer face of the shutter main body 83.

The shutter main body 83 of the discharge shutter 22 is curved in an arc shape along the outer circumferential face of the circumferential wall 31 of the case main body 21. The shutter main body 83 is rotatably supported by the pair of support ribs 45 of the circumferential wall 31.

The stopper 84 of the discharge shutter 22 includes a pair of fulcrum parts 85. The pair of fulcrum parts 85 are engaged with the shutter main body 83. Thereby, the stopper 84 is rotatable around the pair of fulcrum parts 85 with respect to the shutter main body 83. The stopper 84 includes a pair of engagement plates 86. In a state where the toner container 6 is detached from the developing device 10, the pair of engagement plates 86 are engaged with the pair of engagement ribs 46 of the circumferential wall 31 of the case main body 21. Thereby, the discharge shutter 22 is prevented from being rotated with respect to the case main body 21.

Next, the seal member 23 of the toner container 6 will be described.

With reference to FIG. 5 and FIG. 6, the seal member 23 is compressed, and is arranged between the circumferential wall 31 of the case main body 21 and the shutter main body 83 of the discharge shutter 22. The seal member 23 is made of elastic material, for example.

With reference to FIG. 7 and FIG. 8, the seal member 23 includes a first seal part 91 and a second seal part 92 provided at a rear upper side (the upstream side in the rotating direction RD) of the first seal part 91. A boundary part 93 between the first seal part 91 and the second seal part 92 is formed in a step shape.

The first seal part 91 of the seal member 23 is affixed to the outer face of the pedestal 48 of the circumferential wall 31 of the case main body 21, and covers an entire area of the outer face of the pedestal 48. At a center portion of the first seal part 91, a communication port 94 is provided. The communication port 94 is communicated with the discharge port 42 of the circumferential wall 31.

The second seal part 92 of the seal member 23 is affixed to the outer circumferential face of the circumferential wall 31 between the indicating rib 47 and the pedestal 48 of the circumferential wall 31 of the case main body 21. An upper end portion (an end portion at the upstream side in the rotating direction RD) of the second seal part 92 comes into contact with the indicating rib 47 along the left-and-right direction.

Next, the shaft 24 of the toner container 6 will be described.

With reference to FIG. 2, the shaft 24 extends along the left-and-right direction, and penetrates through the circumferential wall 31 of the case main body 21. The shaft 24 is rotatable around the rotation axis X. A right side portion of the shaft 24 penetrates through the bearing 65 of the side wall 32 of the case main body 21. A right end portion (one end portion in the left-and-right direction) of the shaft 24 is arranged outside the case main body 21. Around an outer circumferential face of a center portion in the left-and-right direction of the shaft 24, a screw 96 is provided. A left end portion (the other end portion in the left-and-right direction) of the shaft 24 is inserted in the supporting part 75 of the lid 33 of the case main body 21, and is rotatably supported by the supporting part 75.

Next, the mover 25 of the toner container 6 will be described.

With reference to FIG. 2, the mover 25 partitions the first space S1 and the second space S2 of the case main body 21 in the left-and-right direction. The mover 25 is mounted to an outer circumference of the shaft 24 in a movable state along the left-and-right direction.

The mover 25 includes a seal piece 100, a pair of gripping pieces 101 gripping the seal piece 100 from left and right sides and an engagement piece 102 arranged at a left side of the left gripping piece 101. An outer circumferential face of the seal piece 100 comes into contact with the inner circumferential face of the circumferential wall 31 of the case main body 21 over a whole area in the circumferential direction. On an inner circumferential face of the engagement piece 102, a screw groove 103 is provided. The screw groove 103 is engaged with the screw 96 of the shaft 24. This makes it possible to invert the rotation of the shaft 24 to the movement of the mover 25 along the left-and-right direction.

Next, the agitator 26 of the toner container 6 will be described.

With reference to FIG. 2, FIG. 9 and FIG. 10, the agitator 26 is mounted to an outer circumference of the shaft 24, and is rotatable relative to the shaft 24 around the rotation axis X. An arrow B suitably shown in each figure indicates a rotating direction of the agitator 26.

The agitator 26 includes a holding piece 105, a insertion piece 106 protruding from an inner circumferential portion of the holding piece 105 to the right side (the outside in the left-and-right direction) and a film 107 protruding from an outer circumferential portion of the holding piece 105 to the left side (the inside in the left-and-right direction).

The holding piece 105 of the agitator 26 is stored in a right end portion of the first space S1 of the case main body 21. The holding piece 105 is provided at an interval from the curve 39 of the circumferential wall 31 of the case main body 21. An outer circumferential face of the holding piece 105 is curved in an arc shape. At the outer circumferential portion of the holding piece 105, a notch 108 is provided. On an outer circumferential portion of an inner face (a left face) of the holding piece 105, a mounting part 109 is provided. The mounting part 109 is provided at the upstream side of the notch 108 in the rotating direction of the agitator 26.

The insertion piece 106 of the agitator 26 is formed in a cylindrical shape with the rotation axis X as a center, and extends along the left-and-right direction. The insertion piece 106 is inserted into the bearing 65 of the side wall 32 of the case main body 21. Thereby, the agitator 26 is rotatably supported by the case main body 21. Through the insertion piece 106, the right side portion of the shaft 24 penetrates. Thereby, the right side portion of the shaft 24 is rotatably supported by the agitator 26.

The film 107 of the agitator 26 is made of resin film, such as Polyethylene Terephthalate Film (PET film), and has a flexibility. A base end portion of the film 107 is mounted to the mounting part 109 of the holding piece 105. Thereby, the film 107 is held by the holding piece 105. A tip end portion of the film 107 protrudes to the outer circumferential side (the side remote from the rotation axis X) further than the outer circumferential face of the holding piece 105. A position of the film 107 in the left-and-right direction partially overlaps with a position of the discharge port 42 of the case main body 21 in the left-and-right direction.

Next, the connecting mechanism 27 of the toner container 6 will be described.

With reference to FIG. 2, FIG. 7 and FIG. 8, the connecting mechanism 27 includes a first gear 111, a second gear 112 provided at a right side (the outside in the left-and-right direction) of the first gear 111 and a ratchet mechanism 113 provided at an inner circumferential side (the side closer to the rotation axis X) of the first gear 111.

The first gear 111 of the connecting mechanism 27 includes a first cylindrical part 115 and a first driven gear 117 protruding from an outer circumferential face of the first cylindrical part 115. The first cylindrical part 115 is formed in a cylindrical shape with the rotation axis X as a center, and extends along the left-and-right direction. A left end portion (an end portion at the inside in the left-and-right direction) of the first cylindrical part 115 is fitted to a right end portion (an end portion at the outside in the left-and-right direction) of the insertion piece 106 of the agitator 26. Thereby, the first gear 111 is rotatable integrally with the agitator 26. The first driven gear 117 is formed in an annular shape with the rotation axis X as a center. On an outer circumferential portion of a right face (an outer face) of the first driven gear 117, a moving mark 118 is protruded. The moving mark 118 moves as the first gear 111 rotates.

The second gear 112 of the connecting mechanism 27 includes a second cylindrical part 120 and a second driven gear 122 protruding from an outer circumferential face of the second cylindrical part 120. The second cylindrical part 120 is formed in a cylindrical shape with the rotation axis X as a center, and extends along the left-and-right direction. The second driven gear 122 is formed in an annular shape with the rotation axis X as a center.

With reference to FIG. 2, the ratchet mechanism 113 of the connecting mechanism 27 includes a ratchet shaft 124 and a ratchet gear 125 mounted to an outer circumference of the ratchet shaft 124. The ratchet mechanism. 113 connects the shaft 24 to the second gear 112. The ratchet mechanism 113 transmits the rotation of the second gear 112 to the shaft 24 when the second gear 112 rotates in one direction, and rotates the second gear 112 integrally with the shaft 24. The ratchet mechanism 113 does not transmit the rotation of the second gear 112 to the shaft 24 when the second gear 112 rotates in a direction opposite to the one direction, and idles the second gear 112 with respect to the shaft 24.

Next, the cover 28 of the toner container 6 will be described.

With reference to FIG. 2, FIG. 7 and FIG. 8, the cover 28 is mounted to a right end portion (an end portion in the left-and-right direction) of the case main body 21. The cover 28 covers a right side (the outside in the left-and-right direction) of the side wall 32 of the case main body 21.

The cover 28 includes an outer circumferential wall 127, a closing wall 128 closing a right end portion (an end portion at the outside in the left-and-right direction) of the outer circumferential wall 127 and a protruding wall 129 protruding from an outer face (a right face) of the closing wall 128.

The outer circumferential wall 127 of the cover 28 is formed in a cylindrical shape with the rotation axis X as a center, and extends along the left-and-right direction. The outer circumferential wall 127 covers upper portions of the driven gears 117 and 122 of the gears 111 and 112. At a lower portion of the circumferential wall 127, a window 131 is opened. Through the window 131, lower portions of the driven gears 117 and 122 of the gears 111 and 112 are exposed to the outside of the toner container 6. The outer circumferential wall 127 includes a step 132 at a left side (the inside in the left-and-right direction) of the window 131. On a right face (an outer face) of the step 132, a pair of fixed marks 133 are protruded at a position to be visible from the exterior of the toner container 6.

The closing wall 128 of the cover 28 is provided along a plane crossing the rotation axis X vertically. The closing wall 128 covers right sides (the outside in the left-and-right direction) of the driven gears 117 and 122 of the gears 111 and 112.

The protruding wall 129 of the cover 28 extends along the attachment direction Z. A center portion in the upper-and-lower direction of the protruding wall 129 is recessed to the left side (the inside in the left-and-right direction). A right end portion (an end portion at the outside in the left-and-right direction) of the ratchet shaft 124 is rotatably supported by the protruding wall 129.

Next, the developing device 10 will be described in detail.

Figure 13:
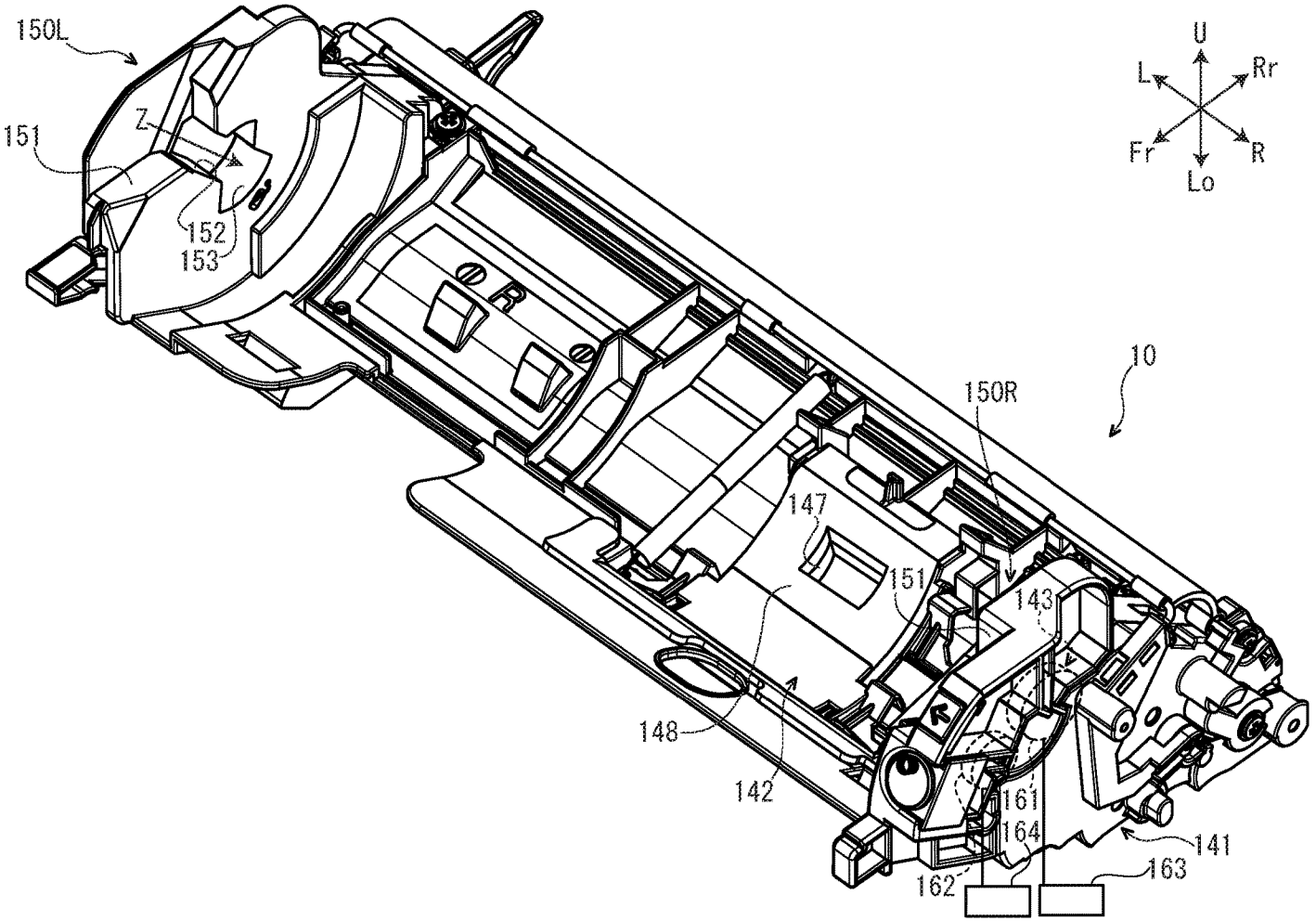
FIG. 13 is a perspective view showing a developing device according to the embodiment of the present disclosure.

With reference to FIG. 5, FIG. 6 and FIG. 13, the developing device 10 includes a casing 141, a replenishment shutter 142 and a drive mechanism 143 which are provided at an upper face side of the casing 141, a pair of mixers 144 stored in the casing 141 and a developing roller 145 provided at a rear side of the pair of mixers 144. Hereinafter, the above members constituting the developing device 10 will be described in the above order.

The casing 141 of the developing device 10 stores the toner. On the upper face of the casing 141, a replenishment port 147 through which the toner is replenished to an inside of the casing 141 is provided. On the upper face of the casing 141, a seal 148 is fixed around the replenishment port 147.

On left and right end portions of the upper face of the casing 141, guide frames 150L and 150R are protruded. On an inner face of each of the guide frames 150L and 150R (a right face of the left guide frame 150L and a left face of the right guide frame 150R), a guide groove 151 is provided. A width of the guide groove 151 in the front-and-rear direction becomes narrower from the upper side (the upstream side in the attachment direction Z) toward the lower side (the downstream side in the attachment direction Z). On the inner face of each of the guide frames 150L and 150R, an introducing groove 152 is provided at a lower side (the downstream side in the attachment direction Z) of the guide groove 151. A width of the introducing groove 152 in the front-and-rear direction is constant. On the inner face of each of the guide frames 150L and 150R, a lock groove 153 is provided at a lower side (the downstream side in the attachment direction Z) of the introducing groove 152. A width of the lock groove 153 in the front-and-rear direction is wider than the width of the introducing groove 152 in the front-and-rear direction.

The replenishment shutter 142 of the developing device 10 is provided along the upper face of the casing 141. The replenishment shutter 142 moves along the upper face of the casing 141, and opens or closes the replenishment port 147 of the casing 141 from the upper side.

The drive mechanism 143 of the developing device 10 includes a first driving gear 161 and a second driving gear 162. The first driving gear 161 is connected to a first drive source 163 constituted by a motor or the others. The second driving gear 162 is connected to a second drive source 164 constituted by a motor and the others.

The pair of mixers 144 of the developing device 10 are rotatably supported by the casing 141. The pair of mixers 144 rotate around rotation axes, and agitate the toner replenished to the inside of the casing 141 through the replenishment port 147.

The developing roller 145 of the developing device 10 is rotatably supported by the casing 141. The developing roller 145 rotates around a rotation axis, and supplies the toner agitated by the pair of mixers 144 to the photosensitive drum 8 (refer to FIG. 1).

Next, an operation in which a worker, such as a user or a serviceman, sets the toner container 6 to the developing device 10 will be described.

Figure 14:
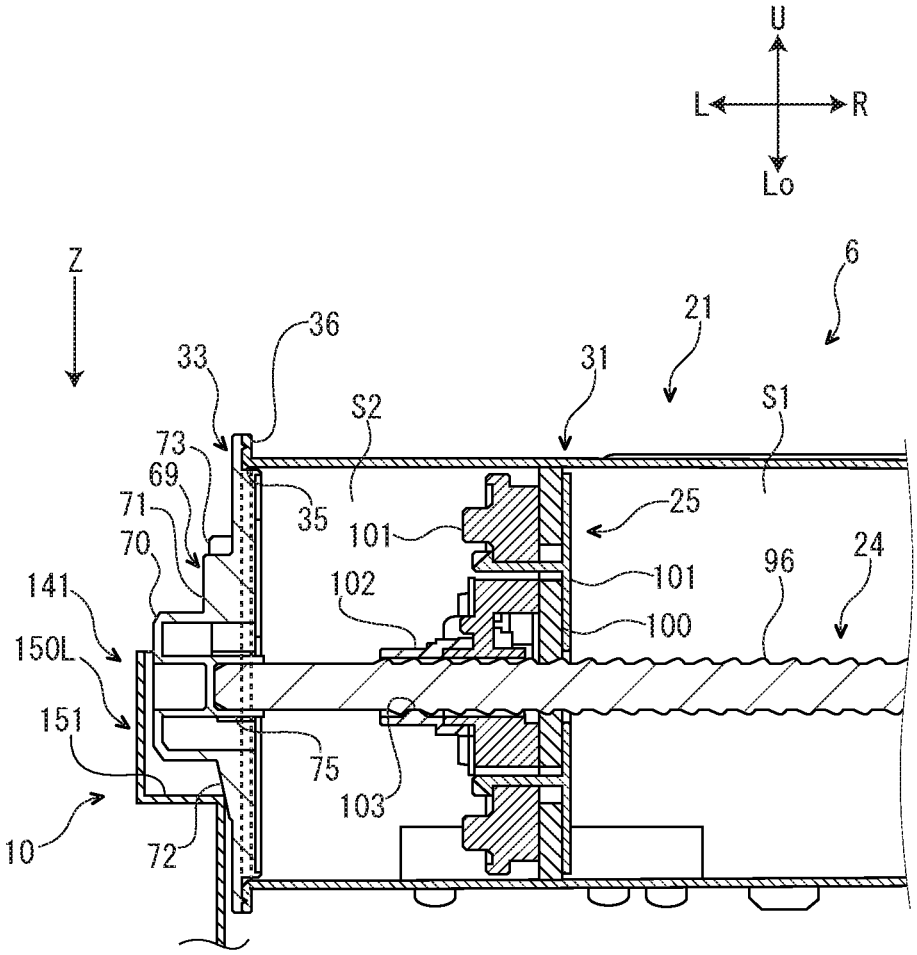
FIG. 14 is a sectional view showing a state in a middle of attaching of the toner container to the developing device, in the embodiment of the present disclosure.

First, the worker moves the toner container 6 toward the developing device 10 downward along the attachment direction Z. Consequently, the protruding piece 70 of the lid 33 of the case main body 21 is inserted into the guide groove 151 of the left guide frame 150L and the protruding wall 129 of the cover 28 is inserted into the guide groove 151 of the right guide frame 150R. At this time, as shown in FIG. 14, the inclined part 72 of the step 69 of the lid 33 comes into contact with an edge of the guide groove 151 of the left guide frame 150L. This avoids the probability that the step 69 of the lid 33 is caught by the guide groove 151 of the left guide frame 150L.

Next, the worker moves the toner container 6 toward the developing device 10 downward further along the attachment direction Z. Then, the protruding piece 70 of the lid 33 of the case main body 21 passes through the guide groove 151 and the introducing groove 152 of the left guide frame 150L, and is inserted into the lock groove 153 of the left guide frame 150L. Meanwhile, the protruding wall 129 of the cover 28 passes through the guide groove 151 and the introducing groove 152 of the right guide frame 150R, and is inserted into the lock groove 153 of the right guide frame 150R. Thereby, as shown in FIG. 3 and FIG. 5, the toner container 6 is attached to the developing device 10 at the first attachment position.

In a state where the toner container 6 is attached to the developing device 10 at the first attachment position, the toner container 6 is allowed to be detached from the developing device 10. The discharge shutter 22 closes the discharge port 42 of the case main body 21 and the communication port 94 of the seal member 23, and the replenishment shutter 142 closes the replenishment port 147 of the casing 141.

Next, as shown in FIG. 4 and FIG. 6, the worker rotates the toner container 6 from the first attachment position to the second attachment position. Thereby, the operation to set the toner container 6 to the developing device 10 is finished.

When the toner container 6 rotates from the first attachment position to the second attachment position as described above, the protruding piece 70 of the lid 33 of the case main body 21 rotates with respect to the lock groove 153 of the left guide frame 150L and the protruding wall 129 of the cover 28 rotates with respect to the lock groove 153 of the right guide frame 150R. Thereby, the toner container 6 is prevented from being detached from the developing device 10. Additionally, when the toner container 6 rotates from the first attachment position to the second attachment position as described above, the first driven gear 117 of the first gear 111 is meshed with the first driving gear 161 and the second driven gear 122 of the second gear 112 is meshed with the second driving gear 162.

Additionally, when the toner container 6 rotates from the first attachment position to the second attachment position as described above, the case main body 21 rotates with respect to the discharge shutter 22. Thereby, the discharge shutter 22 opens the discharge port 42 of the case main body 21 and the communication port 94 of the seal member 23. Additionally, when the toner container 6 rotates from the first attachment position to the second attachment position as described above, the pair of support ribs 45 of the case main body 21 press the replenishment shutter 142. Then, the replenishment shutter 142 is moved along the upper face of the casing 141, and opens the replenishment port 147 of the casing 141.

When the toner container 6 is detached from the developing device 10, the worker rotates the toner container 6 from the second attachment position to the first attachment position, and then pulls out the toner container 6 from the developing device 10 along a direction opposite to the attachment direction Z.

Next, an operation to replenish the toner from the toner container 6 to the developing device 10 (hereinafter, called as "a toner replenishment operation") will be described.

When the toner replenishment operation is performed, the first drive source 163 rotates the first driving gear 161. When the first driving gear 161 is thus rotated, the rotation of the first driving gear 161 is transmitted to the agitator 26 via the first gear 111, and the agitator 26 rotates around the rotation axis X. Thereby, the film 107 of the agitator 26 conveys the toner in the first space S1 of the case main body 21 toward the discharge port 42 while agitating the toner. The toner conveyed toward the discharge port 42 is discharged through the discharge port 42 to the outside of the toner container 6, and is replenished to the inside of the casing 141 of the developing device 10 through the replenishment port 147. Thereby, the toner replenishment operation is finished.

When the above toner replenishment operation is performed, an amount of the toner stored near the discharge port 42 in the first space S1 is reduced. When a toner sensor (not shown) detects that an amount of the toner stored near the discharge port 42 is less than a threshold value, the second drive source 164 rotates the second driving gear 162. When the second driving gear 162 is rotated, the rotation of the second driving gear 162 is transmitted to the shaft 24 via the second gear 112 and the ratchet mechanism 113, and the shaft 24 is rotated around the rotation axis X. When the shaft 24 is rotated, as shown by an arrow A in FIG. 2, the mover 25 mounted to the outer circumference of the shaft 24 moves to the right side (the side of the discharge port 42) along the left-and-right direction. Consequently, a toner storage capacity of the first space S1 of the case main body 21 is reduced, the toner in the first space S1 is pushed by the mover 25 and then moved to the right side (the side of the discharge port 42). As a result, a space near the discharge port 42 is filled with the toner again, and it becomes possible to replenish a sufficient amount of the toner from the toner container 6 to the developing device 10 by the next toner replenishment operation.

Next, a permanent deformation of the film 107 of the agitator 26 and a way to prevent the deformation will be described.

When the agitator 26 rotates around the rotation axis X at the above toner replenishment operation, a rotating position of the agitator 26 is varied.

As shown in FIG. 9, in a state where the agitator 26 is in one rotating position, the tip end portion of the film 107 comes into contact with the inner circumferential face of the curve 39 of the case main body 21. Consequently, the film 107 is deformed in a bent state in an arc shape, and a load applied to the film 107 becomes large. Hereinafter, such a rotating position of the agitator 26 is called as "a first rotating position".

On the other hand, as shown in FIG. 10, in a state where the agitator 26 is in another rotating position different from the first rotating position, the tip end portion of the film 107 is inserted into the recess 40 of the case main body 21, and is separated from the inner circumferential face of the case main body 21. Consequently, the film 107 extends in a flat plate shape, and the load applied to the film 107 becomes small. Hereinafter, such a rotating position of the agitator 26 is called as "a second rotating position".

When the toner container 6 is left for a long period in a state where the agitator 26 is in the first rotating position, for example, when the toner container 6 is stored or transported, the film 107 is kept on being applied with the large load, and then is permanently deformed in the bent state. If the film 107 is permanently deformed in the bent state, a rotating orbit of the film 107 when the toner container 6 is used becomes narrow, and the toner in the first space S1 of the case main body 21 may not be sufficiently agitated and conveyed. Then, the present embodiment prevents the permanent deformation of the film 107 as follows.

Because the agitator 26 and the first gear 111 rotate integrally as described above, the rotating position of the agitator 26 always corresponds to the rotating position of the first gear 111. Then, when the agitator 26 is in a certain rotating position, the first gear 111 is also in a certain rotating position, and the moving mark 118 of the first gear 111 is arranged within a certain region.

Figure 15A:
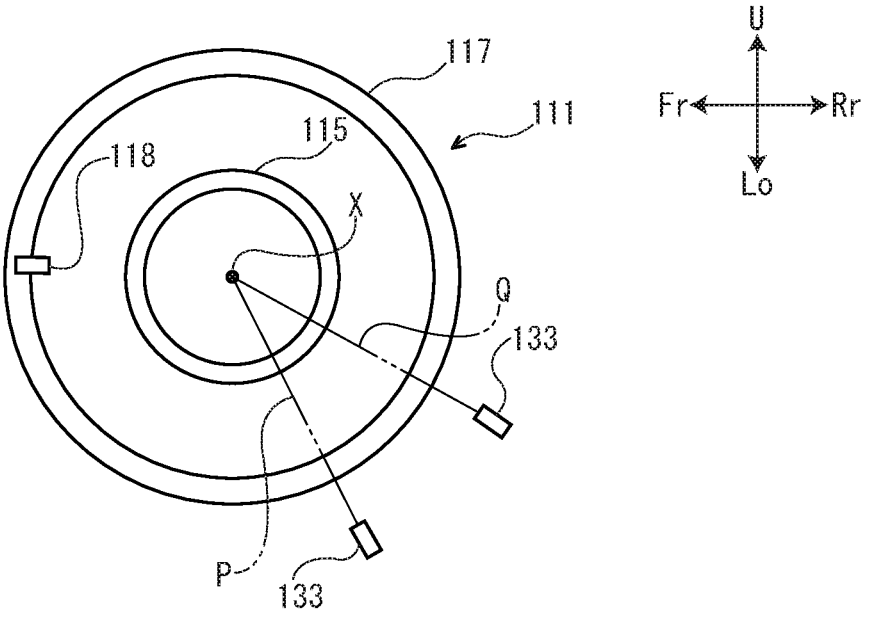
FIG. 15A is a side view showing a positional relationship between a moving mark and a pair of fixed marks in the state where the agitator is in the first rotating position, in the embodiment of the present disclosure.

For example, in a state where the agitator 26 is in the first rotating position (refer to FIG. 9), as shown in FIG. 7 and FIG. 15A, the moving mark 118 of the first gear 111 is arranged in a region at an outside in the circumferential direction of the pair of fixed marks 133 of the cover 28 when viewed in the left-and-right direction (a region which is not between a pair of linear lines P and Q which connect the pair of fixed marks 133 of the cover 28 and the rotation axis X).

Figure 15B:
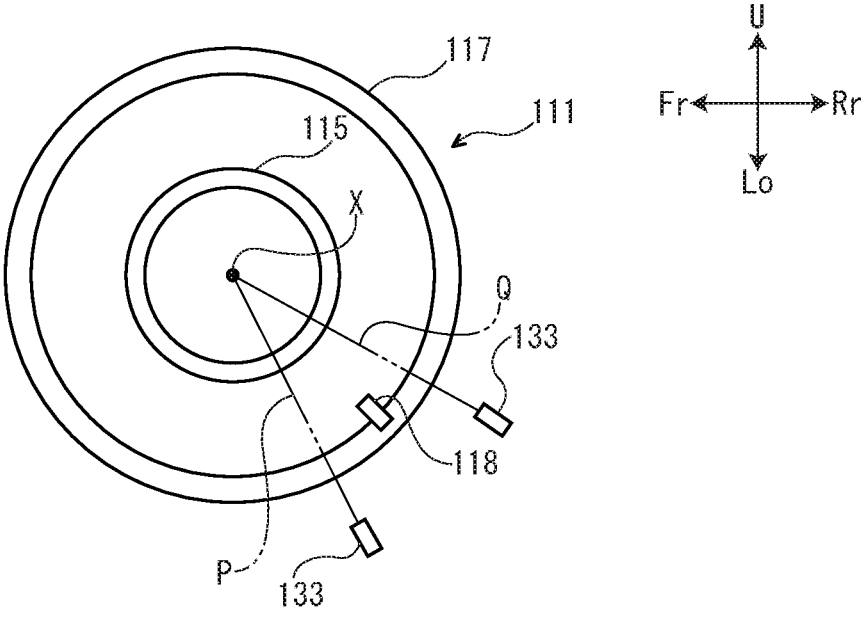
FIG. 15B is a side view showing the positional relationship between the moving mark and the pair of fixed marks in the state where the agitator is in the second rotating position, in the embodiment of the present disclosure.

On the other hand, in a state where the agitator 26 is in the second rotating position (refer to FIG. 10), as shown in FIG. 8 and FIG. 15B, the moving mark 118 of the first gear 111 is arranged in a region at an inside in the circumferential direction of the pair of fixed marks 133 of the cover 28 when viewed in the left-and-right direction (a region which is between the pair of linear lines P and Q which connect the pair of fixed marks 133 of the cover 28 and the rotation axis X). At this time, the moving mark 118 of the first gear 111 is exposed to the outside of the toner container 6 through the window 131 of the cover 28, and is visible from the exterior of the toner container 6.

Then, when the toner container 6 is initially shipped, the worker adjusts the rotating position of the first gear 111 such that the moving mark 118 of the first gear 111 is arranged in the region at the inside in the circumferential direction of the pair of fixed marks 133 of the cover 28 when viewed in the left-and-right direction, and then the toner container 6 is packaged. Thereby, it becomes possible to store or transport the toner container 6 in the state where the agitator 26 is in the second rotating position (the state where the tip end portion of the film 107 is inserted into the recess 40 of the case main body 21). Therefore, it becomes possible to reduce the load applied to the film 107 and to prevent the film 107 from being permanently deformed in the bent state. Accordingly, when the toner container 6 is used, it becomes possible to sufficiently agitate and convey the toner in the first space S1 of the case main body 21.

In the present embodiment, in the state where the agitator 26 is in the first rotating position, the film 107 comes into contact with the inner circumferential face of the curve 39 so that the film 107 is in the bent state. This enhances an agitating force for the toner adhered on the inner circumferential face of the curve 39. On the other hand, in the state where the agitator 26 is in the second rotating position, the film 107 is inserted into the recess 40. This reduces the load applied to the film 107 and then prevents the film 107 from being permanently deformed in the bent state.

Additionally, the replenishment port 66 overlaps with the recess 40 when viewed in the left-and-right direction. By applying such a configuration, a size of an opening of the replenishment port 66 is increased by using the recess 40, and it becomes possible to improve a replenishment efficiency of the toner to the first space S1 of the case main body 21.

As shown in FIG. 9, in the state where the agitator 26 is in the first rotating position, the notch 108 of the holding piece 105 of the agitator 26 is positioned at the left side (the inside in the left-and-right direction) of the replenishment port 66, and the agitator 26 opens the left side of the replenishment port 66. On the other hand, as shown in FIG. 10, in the state where the agitator 26 is in the second rotating position, the holding piece 105 of the agitator 26 is positioned at the left side (the inside in the left-and-right direction) of the replenishment port 66 of the case main body 21, and the agitator 26 covers the left side of the replenishment port 66 partially. Then, when the toner replenishment operation is performed in the state where the agitator 26 is in the first rotating position, it becomes possible to replenish a large amount of toner to the first space S1 of the case main body 21 through the replenishment port 66 at once and to further improve the replenishment efficiency of the toner.

The first gear 111 rotating integrally with the agitator 26 includes the moving mark 118 at a position to be visible from the exterior in the state where the agitator 26 is in the second rotating position. The moving mark 118 moves as the first gear 111 rotates. By applying such a configuration, it becomes possible to recognize the rotating position of the agitator 26 easily based on the position of the moving mark 118.

In the state where the agitator 26 is in the second rotating position, the moving mark 118 is arranged in the region at the inside in the circumferential direction of the pair of fixed marks 133 when viewed in the left-and-right direction. By applying such a configuration, based on the position of the moving mark 118 and the pair of fixed marks 133, it becomes possible to easily recognize that the agitator 26 is in the second rotating position.

The curve 39 has the discharge port 42 through which the toner is discharged from the first space S1 of the case main body 21. Additionally, in the state where the agitator 26 is in the first rotating position, the film 107 comes into contact with the inner circumferential face of the curve 39 so that the film 107 is in the bent state, and in the state where the agitator 26 is in the second rotating position, the film 107 is inserted into the recess 40. By applying such a configuration, it becomes possible to prevent the permanent deformation of the film 107 surely while allowing the effective discharge of the toner through the discharge port 42.

In the state where the agitator 26 is in the second rotating position, the film 107 is separated from the inner circumferential face of the case main body 21. By applying such a configuration, it becomes possible to prevent the permanent deformation of the film 107 more surely.

In the present embodiment, the film 107 is separated from the inner circumferential face of the case main body 21 in the state where the agitator 26 is in the second rotating position. On the other hand, in another embodiment, the film 107 may slightly come into contact with the inner circumferential face of the case main body 21 in the state where the agitator 26 is in the second rotating position.

In the present embodiment, the side wall 32 of the case main body 21 is formed integrally with the circumferential wall 31 of the case main body 21. On the other hand, in another embodiment, the side wall 32 of the case main body 21 may be formed separately from the circumferential wall 31 of the case main body 21.

In the present embodiment, the lid 33 of the case main body 21 is formed separately from the circumferential wall 31 and the side wall 32 of the case main body 21. On the other hand, in another embodiment, the lid 33 of the case main body 21 may be formed integrally with the circumferential wall 31 and the side wall 32 of the case main body 21.

In the present embodiment, the shaft 24 is set to be a rotator. On the other hand, in another embodiment, an agitating paddle agitating the toner in the case main body 21 or a conveying screw conveying the toner in the case main body 21, except the shaft 24, may be set to be a rotator.

In the present embodiment, the configuration of the present disclosure is applied to the toner container 6 in which the toner storage capacity of the first space S1 of the case main body 21 is varied as the mover 25 moves in the left-and-right direction. On the other hand, in another embodiment, the configuration of the present disclosure may be applied to the toner container 6 in which the toner storage capacity of the first space S1 of the case main body 21 is not varied.

In the present embodiment, the image forming apparatus 1 is a printer. On the other hand, in another embodiment, the image forming apparatus 1 may be a printer, a copying machine, a facsimile or a multifunctional peripheral (an image forming apparatus containing multiple functions of a printing function, a copying function and a facsimile function).

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. A toner case comprising:
a case main body storing a toner; and
an agitator rotating around a rotation axis extending along one direction and agitating the toner stored in the case main body,
wherein the case main body includes:
a curve curved in an arc shape around the rotation axis; and
a recess recessed from the curve toward a side remote from the rotation axis,
wherein in a state where the agitator is in a first rotating position, a part of the agitator comes into contact with an inner circumferential face of the curve so that the part of the agitator is in a bent state, and in a state where the agitator is in a second rotating position, the part of the agitator is inserted into the recess,
wherein the case main body includes:
a cylindrical circumferential wall extending along the one direction; and
a side wall closing an end portion of the circumferential wall in the one direction,
wherein the curve and the recess are provided at the end portion of the circumferential wall in the one direction, and
the side wall has a replenishment port through which the toner is replenished to the case main body, and
the replenishment port overlaps with the recess when viewed in the one direction.

2. The toner case according to claim 1,
wherein in the state where the agitator is in the first rotating position, the agitator opens an inside of the replenishment port in the one direction, and in the state where the agitator is in the second rotating position, the agitator partially covers the inside of the replenishment port in the one direction.

3. A toner case comprising:
a case main body storing a toner; and
an agitator rotating around a rotation axis extending along one direction and agitating the toner stored in the case main body,
wherein the case main body includes:
a curve curved in an arc shape around the rotation axis; and
a recess recessed from the curve toward a side remote from the rotation axis,
wherein in a state where the agitator is in a first rotating position, a part of the agitator comes into contact with an inner circumferential face of the curve so that the part of the agitator is in a bent state, and in a state where the agitator is in a second rotating position, the part of the agitator is inserted into the recess,
the toner case further comprising a gear arranged at an outside of the case main body in the one direction and rotating integrally with the agitator,
wherein the gear includes a moving mark at a position to be visible from an exterior in the state where the agitator is in the second rotating position, the moving mark moving as the gear rotates.

4. The toner case according to claim 3, further comprising a cover covering the gear partially,
wherein the cover includes a pair of fixed marks at a position to be visible from the exterior, and
in the state where the agitator is in the second rotating position, the moving mark is arranged in a region at an inside in a circumferential direction of the pair of fixed marks when viewed in the one direction.

5. An image forming apparatus comprising:
the toner case according to claim 3, and
an attachment part to which the toner case is attached.

6. A toner case comprising:
a case main body storing a toner; and
an agitator rotating around a rotation axis extending along one direction and agitating the toner stored in the case main body,
wherein the case main body includes:
a curve curved in an arc shape around the rotation axis; and
a recess recessed from the curve toward a side remote from the rotation axis, wherein in a state where the agitator is in a first rotating position, a part of the agitator comes into contact with an inner circumferential face of the curve so that the part of the agitator is in a bent state, and in a state where the agitator is in a second rotating position, the part of the agitator is inserted into the recess, wherein the curve has a discharge port through which the toner is discharged from the case main body, and the agitator includes:

a holding piece provided at an interval from the curve; and a film held by the holding piece, wherein in the state where the agitator is in the first rotating position, the film comes into contact with the inner circumferential face of the curve so that the film is in a bent state, and in the state where the agitator is in the second rotating position, the film is inserted into the recess.

7. The toner case according to claim 6, wherein in the state where the agitator is in the second rotating position, the film is separated from an inner circumferential face of the case main body.

8. The toner case according to claim 6, wherein the film protrudes from the holding piece toward an inside in the one direction, and a position of the film in the one direction partially overlaps with a position of the discharge port in the one direction.

9. An image forming apparatus comprising:

the toner case according to claim 6, and an attachment part to which the toner case is attached.

10. The toner case according to claim 1, further comprising:

a rotator stored in the case main body and rotating around the rotation axis; and a mover mounted to an outer circumference of the rotator, the mover moving along the one direction as the rotator rotates so as to vary a toner storage capacity of the case main body.

11. A toner case comprising:

a case main body storing a toner; and an agitator rotating around a rotation axis extending along one direction and agitating the toner stored in the case main body, wherein the case main body includes:

a curve curved in an arc shape around the rotation axis; and a recess recessed from the curve toward a side remote from the rotation axis, wherein in a state where the agitator is in a first rotating position, a part of the agitator comes into contact with an inner circumferential face of the curve so that the part of the agitator is in a bent state, and in a state where the agitator is in a second rotating position, the part of the agitator is inserted into the recess, wherein the recess is curved in an arc shape, and a radius of curvature of the recess is smaller than a radius of curvature of the curve.

12. An image forming apparatus comprising:

the toner case according to claim 11, and an attachment part to which the toner case is attached.

13. The toner case according to claim 1, wherein the recess is provided continuously with the curve.

14. An image forming apparatus comprising:

the toner case according to claim 1, and an attachment part to which the toner case is attached.

* * * * *